US008677726B2

(12) United States Patent
Wesson et al.

(10) Patent No.: US 8,677,726 B2
(45) Date of Patent: Mar. 25, 2014

(54) METHOD OF MAKING AN ELEVATOR BELT

(75) Inventors: John P. Wesson, Vernon, CT (US); Mark R. Gurvich, Middletown, CT (US)

(73) Assignee: Otis Elevator Company, Farmington, CT (US)

( * ) Notice: Subject to any disclaimer, the term of this patent is extended or adjusted under 35 U.S.C. 154(b) by 420 days.

(21) Appl. No.: 13/123,795

(22) PCT Filed: Nov. 14, 2008

(86) PCT No.: PCT/US2008/083491

§ 371 (c)(1), (2), (4) Date: Apr. 12, 2011

(87) PCT Pub. No.: WO2010/056247

PCT Pub. Date: May 20, 2010

(65) Prior Publication Data

US 2011/0240408 A1 Oct. 6, 2011

(51) Int. Cl.
*D07B 1/16* (2006.01)
*D07B 1/22* (2006.01)

(52) U.S. Cl.
USPC ..... 57/223; 57/232

(58) Field of Classification Search
USPC ..... 57/223, 232, 234, 236, 241; 198/844.1, 198/847
See application file for complete search history.

(56) References Cited

U.S. PATENT DOCUMENTS 2,545,370 A 3/1951 Mittelmann
2,577,427 A * 12/1951 McDermott et al. ..... 138/129
3,464,197 A * 9/1969 Martin ..... 57/225
4,022,010 A 5/1977 Gladenbeck et al.
4,197,695 A * 4/1980 Hughes et al. ..... 57/7
4,227,041 A * 10/1980 Den et al. ..... 174/117 F
4,531,959 A 7/1985 Kar et al.
4,550,559 A 11/1985 Thomson
5,881,843 A 3/1999 O'Donnell et al.
6,364,061 B2 * 4/2002 Baranda et al. ..... 187/254
6,401,871 B2 6/2002 Baranda et al.
6,412,265 B1 * 7/2002 Yamamoto et al. ..... 57/242
6,863,761 B2 * 3/2005 Knutson ..... 156/137
6,983,826 B2 1/2006 Wake et al.
7,086,217 B2 8/2006 Eichhorn et al.

(Continued)

FOREIGN PATENT DOCUMENTS

DE 2538691 A1 3/1977
DE 87 02 678.3 7/1987

(Continued)

OTHER PUBLICATIONS

Search Report and Written Opinion mailed on Aug. 17, 2009 for PCT/US2008/083491.

(Continued)

*Primary Examiner* — Shaun R Hurley
(74) *Attorney, Agent, or Firm* — Carlson, Gaskey & Olds

(57) ABSTRACT

An exemplary method of making a load bearing elevator traction belt includes applying individual coatings of a jacket material to each of a plurality of tension members such that each tension member is individually coated separately from the other tension members. A portion of the individual coatings are joined together to secure the tension members into a desired alignment and to form a single jacket that establishes a geometry of the belt.

17 Claims, 4 Drawing Sheets

(56) References Cited

U.S. PATENT DOCUMENTS

| | | | | |
|---|---|---|---|---|
| 2002/0000346 | A1 | 1/2002 | Baranda et al. | |
| 2003/0078125 | A1* | 4/2003 | Knutson | 474/260 |
| 2003/0092524 | A1 | 5/2003 | Baranda et al. | |
| 2004/0083707 | A1* | 5/2004 | Eichhorn et al. | 57/241 |
| 2004/0206579 | A1 | 10/2004 | Baranda et al. | |
| 2005/0274101 | A1* | 12/2005 | Wang | 57/241 |
| 2006/0180402 | A1 | 8/2006 | Silberhorn et al. | |
| 2011/0226562 | A1* | 9/2011 | Goser | 187/411 |
| 2011/0226563 | A1* | 9/2011 | Goser | 187/411 |

FOREIGN PATENT DOCUMENTS

| | | | |
|---|---|---|---|
| EP | 1886958 | A | 2/2008 |
| JP | 5960909 | | 4/1984 |
| JP | 60159719 | | 10/1985 |
| WO | WO98/31892 | A | 7/1998 |
| WO | 03042085 | | 5/2003 |
| WO | WO2008/110241 | A | 9/2008 |
| WO | WO2008/013861 | A | 11/2008 |
| WO | WO2008/135317 | A | 11/2008 |

OTHER PUBLICATIONS

International Preliminary Report on Patentability for International application No. PCT/US2008/083491 mailed May 26, 2011.

Chinese Search Report for Application No. 200880132006.7 dated Feb. 18, 2013.

* cited by examiner

METHOD OF MAKING AN ELEVATOR BELT

BACKGROUND

Elevator systems are useful for carrying passengers, cargo or both between various levels in a building, for example. Some elevator systems are traction-based and utilize load bearing traction members such as ropes or belts for supporting the elevator car and achieving the desired movement and placement of the elevator car.

Example belts are shown in U.S. Pat. Nos. 6,295,799; 6,364,061; and 6,739,433.

Techniques for making such belts have included using a mold wheel to support cords as they are covered by a thermoplastic polymer. One disadvantage to the mold wheel process is that it results in grooves on the exterior surface of the jacket of the belt because of how the cords are supported on the mold wheel during the manufacturing process. Such grooves are believed to be disadvantageous.

One challenge associated with known processes for making such belts includes controlling the position of the cords during the jacket application process. The position must be controlled and maintained precisely to provide a belt of a desired configuration. Additionally, there are challenges associated with securing the elastomer jacket material to the cords.

Further, the jacket material must flow during the manufacturing process to provide good control on the outer dimensions of the jacket. This requirement for elastomer flow sets a lower limit on the thickness of the jacket layer that can be achieved. In a linear extrusion process, the orifice must be wide enough to allow reasonably linear flow at linear speeds that are high enough to make a practical elevator belt. In a mold wheel process, an elastomer must be present to allow flow to completely and uniformly coat each cord.

It would be useful to be able to minimize or avoid such challenges and considerations when making a belt for use as an elevator load bearing and traction member.

SUMMARY

An exemplary method of making a load bearing elevator traction belt includes applying individual coatings of a jacket material to each of a plurality of tension members such that each tension member is individually coated separately from the other tension members. A portion of the individual coatings are joined together to secure the tension members into a desired alignment and to form a single jacket that establishes the geometry of the belt.

The various features and advantages of the disclosed examples will become apparent to those skilled in the art from the following detailed description. The drawings that accompany the detailed description can be briefly described as follows.

DETAILED DESCRIPTION

Figure 1:
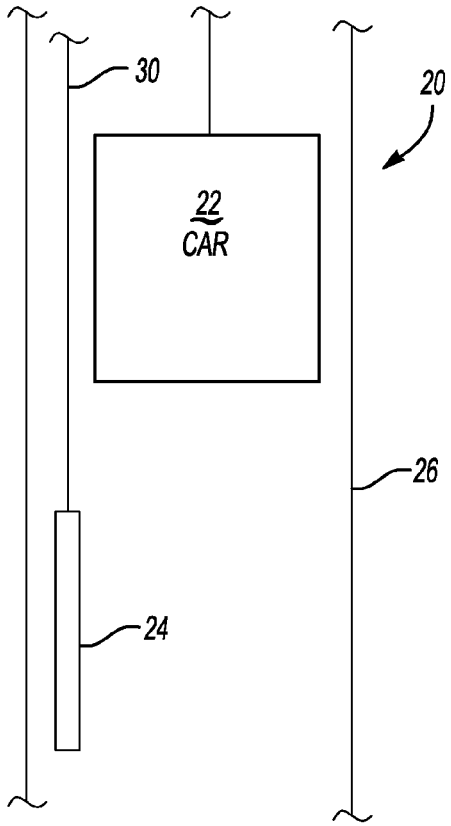
FIG. 1 schematically illustrates selected portions of an elevator system.

FIG. 1 schematically illustrates selected portions of a traction elevator system 20. An elevator car 22 and counterweight are supported within a hoistway 26 for movement in a generally known manner. A load bearing elevator traction belt (LBETB) 30 supports the weight of the car 22 and the counterweight 24 and interacts with a drive machine (not shown) to achieve the desired movement and placement of the elevator car 22 within the hoistway 26. The LBETB 30 is one example type of elevator belt that can be made using a process consistent with this disclosure. Other types of elevator belts include belts that are used for tension or suspension but that do not provide a traction or propulsion function. Other example elevator belts may be used for propulsion without being used for suspension.

Figure 2:
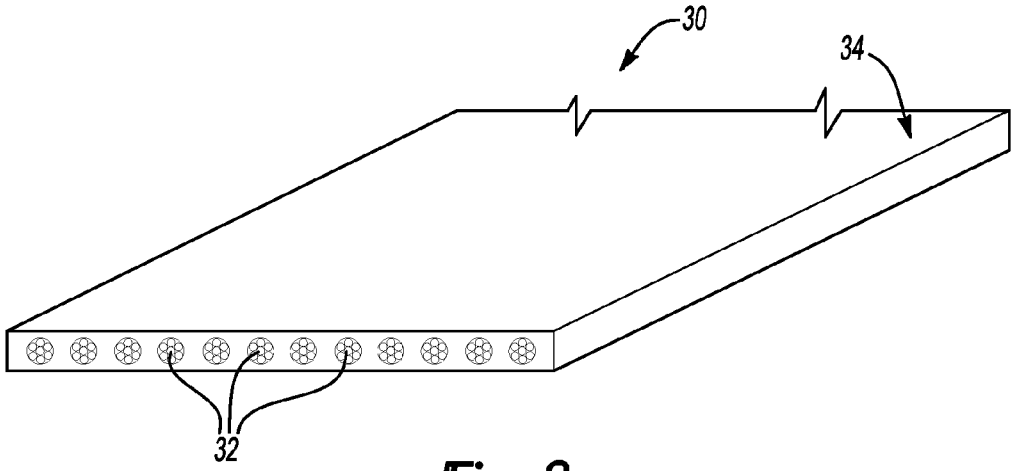
FIG. 2 is a diagrammatic, perspective illustration of an example load bearing elevator traction belt.

FIG. 2 illustrates one example LBETB 30. This example includes a plurality of tension members 32 that extend along a length of the LBETB 30. The tension members 32 may comprise a variety of materials. In one example, the tension members 32 comprise steel cords. In another example, the tension members 32 comprise polymer materials.

The LBETB 30 includes a jacket 34 that at least partially surrounds the tension members 32. In the example of FIG. 2, the jacket 34 completely surrounds each of the tension members 32 with jacket material between the tension members 32. In this example, the spacing between adjacent tension members 32 is filled with the jacket material. The jacket 34 comprises an elastomer. One example includes a thermoplastic elastomer jacket material. One example jacket 34 comprises urethane.

Figure 3:
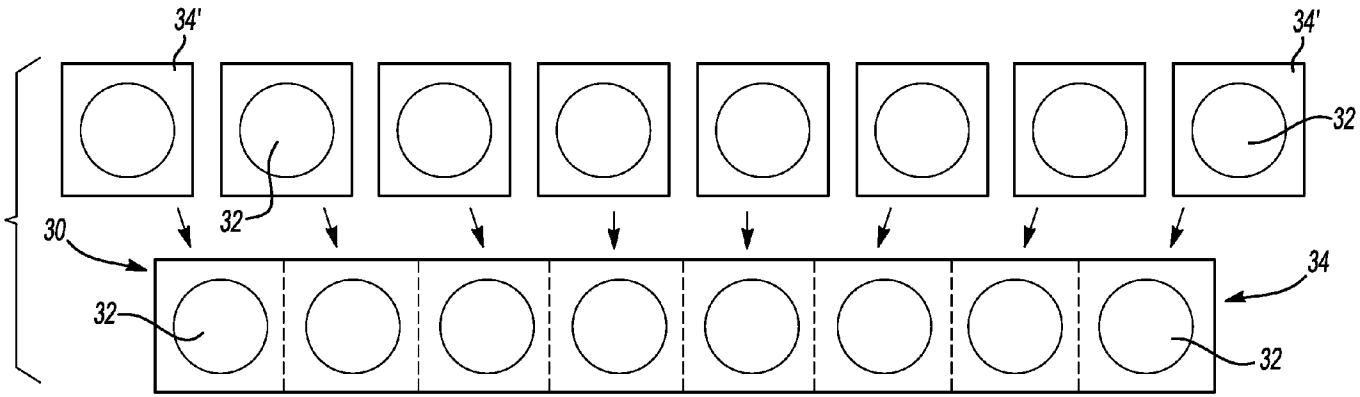
FIG. 3 schematically illustrates an example process of making one example load bearing elevator traction belt.

FIG. 3 schematically illustrates a technique for making the example of FIG. 2. In this example, each of the tension members 32 is individually coated with a coating 34' of jacket material used to establish the jacket 34. The individually coated tension members 32 are then joined together by joining a portion of the individual coatings 34' as schematically shown at 36. Joining the individual coatings 34' together secures the tension members 32 into a desired alignment to form a single LBETB 30. The resulting structure has a desired geometry corresponding to the final shape of the jacket 34 and the positions of the tension members 32.

Joining the individual coatings 34' together in one example includes at least partially melting the jacket material of the individual coatings 34' at least in the vicinity of the areas indicated at 36 to join the coatings of adjacent coatings. One example includes joining the coatings 34' by fusing the jacket material of the coatings to that of adjacent coatings 34'. Another example includes joining the coatings 34' together by welding the jacket material of the individual coatings 34' together.

One example includes adhesively joining the individual coatings 34' together by applying an adhesive to an interface 36 between adjacent ones of the coatings 34'. Another example includes introducing a molten thermoplastic material onto selected portions of adjacent individual coatings 34' to adhesively secure them together.

In the example of FIGS. 2 and 3, the tension members 32 are aligned in a generally linear orientation such that a centerline of each tension member 32 is in line with every other tension member centerline. In the example of FIGS. 2 and 3, the geometry of the LBETB 30 has a generally rectangular cross-section. Other belt geometries are possible with the example technique of forming a LBETB 30.

Figure 4:
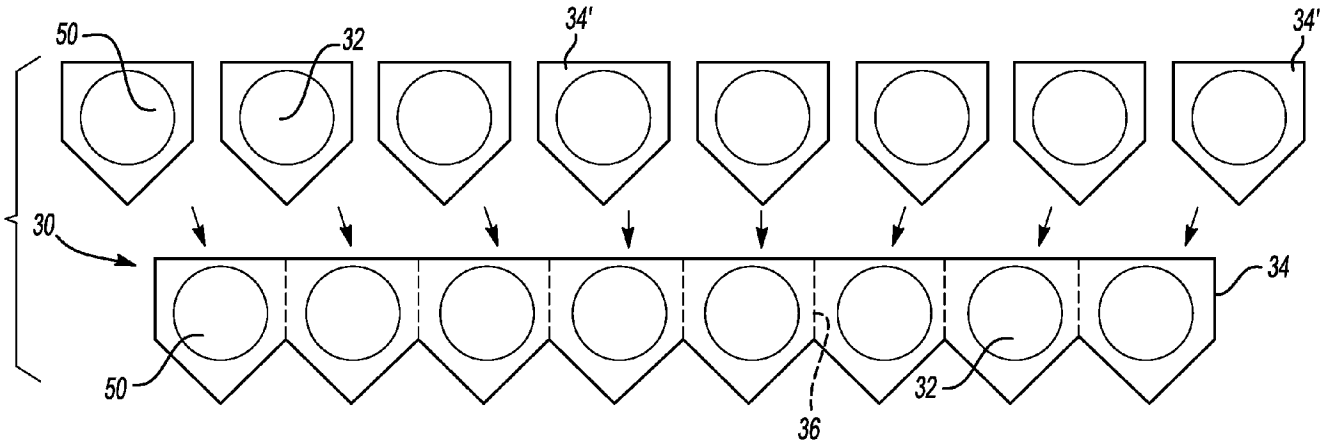
FIG. 4 schematically illustrates a process of making anther example load bearing elevator traction belt.

FIG. 4 schematically illustrates an example LBETB 30 that includes a jacket geometry that is different on one side compared to the other.

Figure 5:
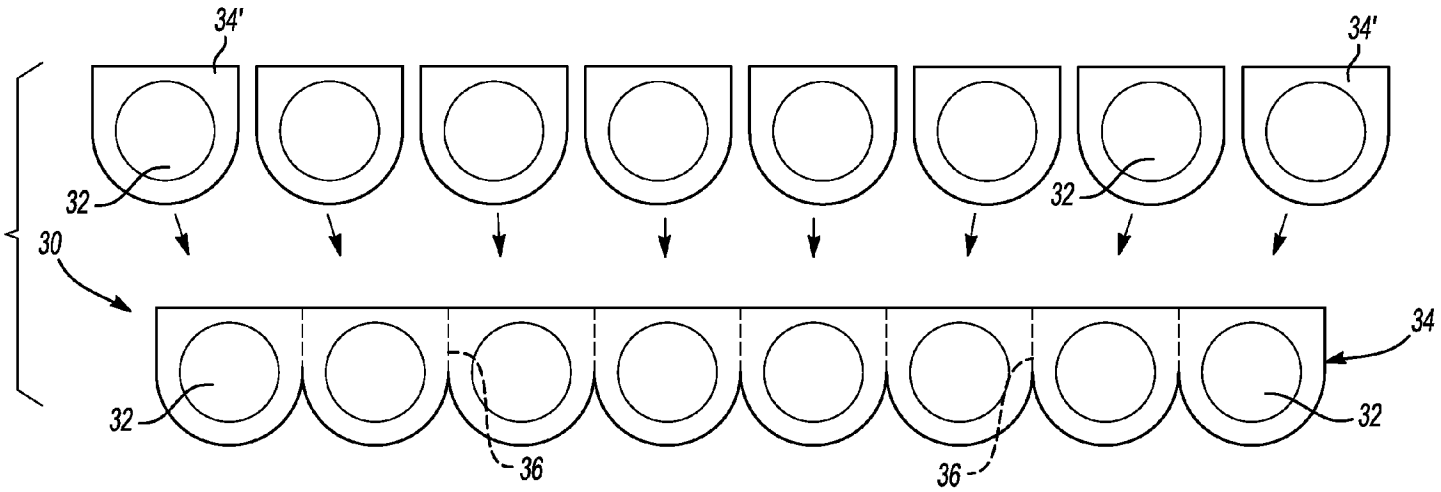
FIG. 5 schematically illustrates a process of making another example load bearing elevator traction belt.

FIG. 5 schematically illustrates another example where one side of the jacket 34 has a different configuration than the other.

Figure 6:
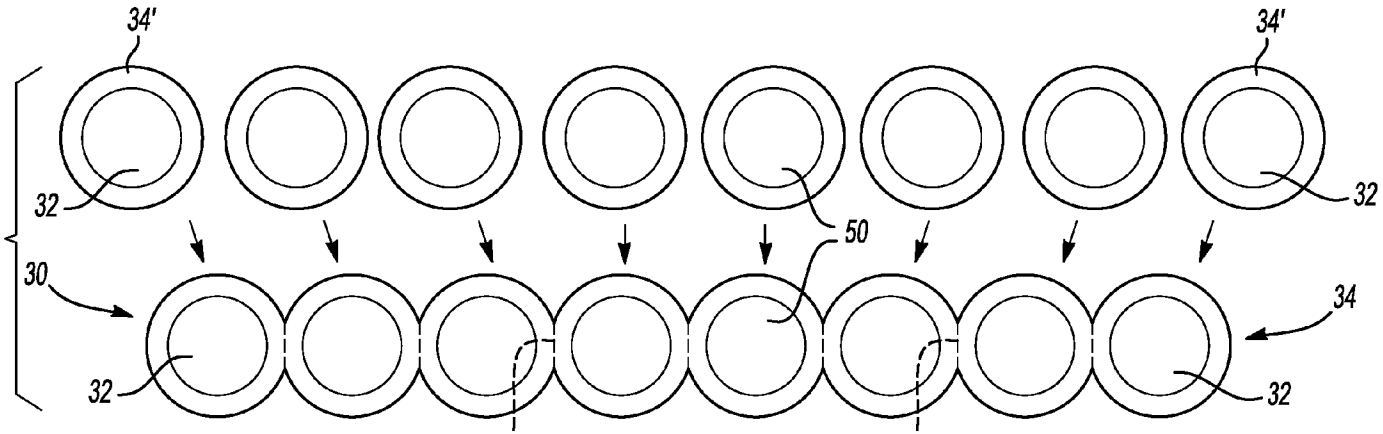
FIG. 6 schematically illustrates a process of making another example load bearing elevator traction belt.

FIG. 6 schematically illustrates another example where neither side of the LBETB 30 has a planar surface. Instead, in this example, both sides have a plurality of curvilinear portions along the cross-section of the jacket 34.

Figure 7:
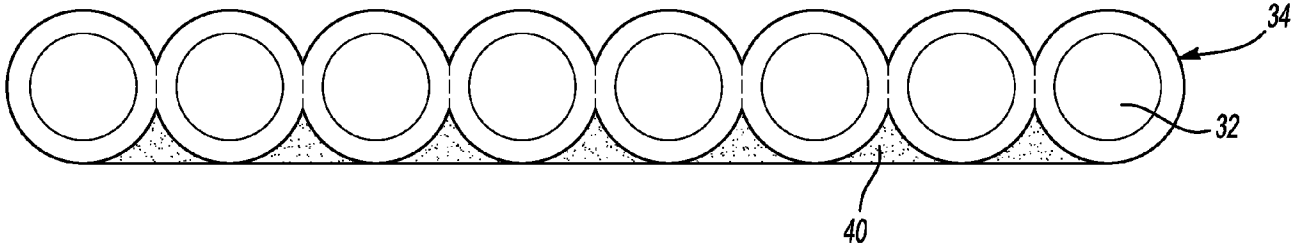
FIG. 7 schematically illustrates another example load bearing elevator traction belt.

FIG. 7 schematically illustrates another example where a first jacket material is used to establish the coatings 34' and another jacket material 40 is secured to appropriate portions of the individual coatings 34'. This example allows for utilizing the embodiment of FIG. 6 with an additional material to achieve a generally planar surface on at least one side of the LBETB 30. In some examples, the individual coatings will be secured together independent of the additional material 40. In other examples, the additional material 40 is operative to secure the individual coatings together in a desired alignment relative to each other.

Figure 8:
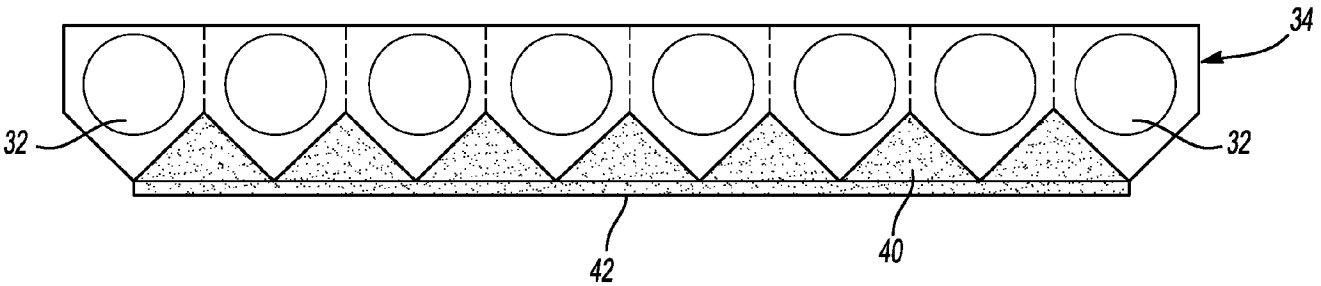
FIG. 8 schematically illustrates another example load bearing elevator traction belt.

FIG. 8 schematically illustrates another example where a second additional material 42 is secured to an exterior surface of the jacket 34. In this example, the additional material 42 comprises a fabric having selected surface properties that are distinct from those of the polymer material used for the individual coatings 34'. Providing different surfaces on different sides of the example LBETB 30 in FIG. 8 allows for achieving different traction characteristics depending on which side of the example belt contacts sheaves in an elevator system, for example.

There are various features associated with the disclosed technique for making an LBETB. The thickness of the coating (e.g., the cross-sectional dimensions of the jacket 34) can be varied according to the needs of particular situations. For example, it is possible to use much thinner coatings 34' when individually coating the tension members 32 compared to applying a jacket material to an entire series of tension members simultaneously. Additionally, it is possible to achieve thicker coatings compared to previous techniques if that is desired. The addition of another material such as the example materials 40 and 42 in FIGS. 7 and 8 allows for modifying one or both surfaces of the LBETB 30. Such an additional material can overcome any limitations associated with the surface characteristics of the jacket material used for the individual coatings 34'. For example, the individual coatings 34' may need to comprise thermoplastic elastomers having particular characteristics to securely join the individual coatings 34' together. The addition of different materials 40, 42 or both allows for achieving the efficiencies associated with individually coating tension members 32 while still having a wide selection of potential surface characteristics based upon the selected materials for the jacket 34.

Another feature of some of the illustrated examples such as those in FIGS. 4 and 6 is that an elongated member 50 can be individually coated with a coating 54' that may be the same material used for the individual coatings 34'. The elongated member 50 is different than the tension members 32. For example, the elongated member 50 may be a non-load bearing member that provides other features within the LBETB 30. In one example, fiber optics are included to provide the ability to communicate information along the length of the LBETB 30. Another example includes a conductive member that is useful for electrically measuring characteristics such as strength of the LBETB 30 during its service life. Individually coating the tension members 32 and the other elongated member 50 and then joining those individual coatings together allows for more conveniently incorporating different materials into the LBETB 30, which can provide additional features for particular situations.

Figure 9:
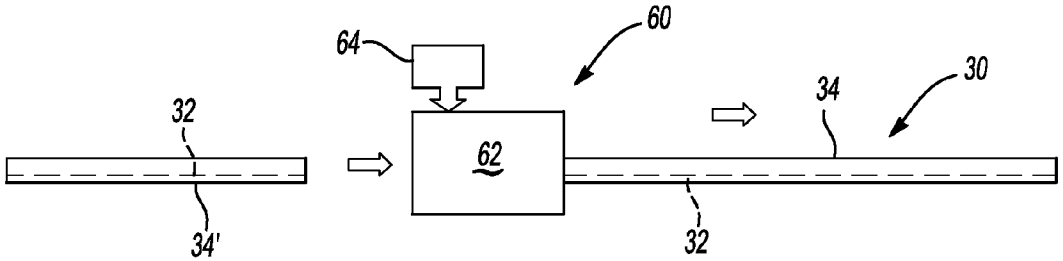
FIG. 9 schematically illustrates equipment used for making one or more of the examples of the other Figures.

FIG. 9 schematically shows equipment 60 for making one or more of the disclosed example LBEBT configurations. A molding device 62 receives the individually coated tension members 32 and secures them together. The molding device 62 in one example includes an extruder. A thermoplastic elastomer 64 is also introduced into the extruder molding device 62 and used for fusing the individual coatings together.

In another example, the molding device 62 includes a mold wheel upon which the individually coated tension members 32 are placed. A thermoplastic elastomer 64 is added onto the coatings on the mold wheel. The individual coatings 34' are fused together using the additional thermoplastic elastomer.

In one example, the molding device 62 includes a heated mold wheel. Each individually coated tension member 32 is guided onto the hot mold wheel. Controlling the temperature of the mold wheel allows for avoiding any movement of the tension members 32 within their individual coatings 34' during the joining process. This also allows for more precisely controlling the positions of the tension members 32 within the assembly and controlling the amount of elastomer used for the jacket 34.

The example manufacturing techniques for an LBETB 30 allow for faster manufacture at a lower cost and increase the capacity for incorporating different material. With the disclosed examples, better cord position control can be achieved compared to previous arrangements. Having better cord position control results in more consistent belt geometry.

With the disclosed examples, a wider variety of belt configurations become possible without complicating or reducing the economies of a manufacturing process.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of making an elevator belt, comprising the steps of:

applying individual coatings of a jacket material to each of a plurality of tension members such that each tension member is individually coated separately from the other tension members, each of the individual coatings having an at least partially generally rectangular cross-section that is consistently oriented along a length of the corresponding tension member;

aligning the tension members in a generally linear orientation such that a centerline of each tension member is in line with every other tension member centerline; and joining a portion of the individual coatings together to secure the tension members into a desired alignment and to form a single jacket that establishes a geometry of the belt, the geometry of the belt being at least partially generally rectangular in cross-section.

2. The method of claim 1, wherein the joining comprises positioning the individual coatings adjacent each other; and at least partially melting the jacket material to join the coatings to the adjacent coatings.

3. The method of claim 1, wherein the joining comprises fusing the jacket material of one of the coatings to the jacket material of another one of the coatings.

4. The method of claim 1, wherein the joining comprises welding the jacket material of one of the coatings to the jacket material of another one of the coatings.

5. The method of claim 1, comprising securing additional material to the coatings when joining the individual coatings together.

6. The method of claim 5, wherein the additional material is the same material as the jacket material of the coatings.

7. The method of claim 5, wherein the additional material comprises a fabric.

8. The method of claim 5, comprising shaping the additional material to establish at least one side of the geometry of the belt.

9. The method of claim 1, comprising adhesively joining the individual coatings together by applying an adhesive to an interface between adjacent ones of the coatings.

10. The method of claim 1, comprising feeding the individually coated tension members into an extruder;

introducing a thermoplastic elastomer into the extruder; and fusing the individual coatings together using the thermoplastic elastomer.

11. The method of claim 1, comprising placing the individually coated tension members onto a mold wheel;

adding a thermoplastic elastomer onto the coatings on the mold wheel; and fusing the individual coatings together using the thermoplastic elastomer.

12. The method of claim 1, wherein the jacket material comprises an elastomer.

13. The method of claim 12, wherein the jacket material comprises a thermoplastic elastomer.

14. The method of claim 1, wherein the belt includes at least one elongated member that is distinct from the tension members and the method comprises individually coating the at least one elongated member.

15. The method of claim 1, comprising heating the individual coatings during the joining.

16. The method of claim 1, comprising at least partially changing a shape of at least some of the coatings during the joining.

17. The method of claim 1, wherein one side of the generally rectangular cross-section of the geometry of the belt has a dimension corresponding to a dimension of one side of the individual coatings rectangular cross-section.

* * * * *